US011393299B2

(12) United States Patent
Pratten et al.

(10) Patent No.: US 11,393,299 B2
(45) **Date of Patent: *Jul. 19, 2022**

(54) SYSTEM AND METHOD FOR CONFIGURING AN AUTOMATED TELLER MACHINE USER INTERFACE BASED ON LOADED CASSETTES

(71) Applicant: The Toronto-Dominion Bank, Toronto (CA)

(72) Inventors: A Warren Pratten, London (CA); Vincent Fazio, Middletown, DE (US); Anthony Wayne Miles, London (CA); Nigel John Shipley, Markham (CA)

(73) Assignee: The Toronto-Dominion Bank, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/490,258

(22) Filed: Sep. 30, 2021

(65) Prior Publication Data

US 2022/0020245 A1 Jan. 20, 2022

Related U.S. Application Data

(63) Continuation of application No. 16/893,965, filed on Jun. 5, 2020, now Pat. No. 11,151,846.

(60) Provisional application No. 63/000,858, filed on Mar. 27, 2020.

(51) Int. Cl.
*G07F 19/00* (2006.01)

(52) U.S. Cl.
CPC ..... *G07F 19/205* (2013.01); *G07F 19/206* (2013.01)

(58) Field of Classification Search
CPC ..... G07F 19/205; G07F 19/206
USPC ..... 705/43
See application file for complete search history.

(56) References Cited

U.S. PATENT DOCUMENTS

| | | | | |
|---|---|---|---|---|
| 5,984,177 | A | 11/1999 | Do et al. | |
| 6,935,558 | B2 | 8/2005 | Washington et al. | |
| 7,219,832 | B2 | 5/2007 | Fillinger et al. | |
| 7,950,574 | B1 | 5/2011 | Ramachandran et al. | |
| 8,301,564 | B2 | 10/2012 | Mon et al. | |
| 8,317,089 | B2 | 11/2012 | Brexel et al. | |
| 8,600,842 | B1 | 12/2013 | Sanders et al. | |
| 9,443,399 | B2 | 9/2016 | Turocy et al. | |
| 9,646,465 | B2 | 5/2017 | VanKirk et al. | |
| 10,402,801 | B1 | 9/2019 | Edwards et al. | |
| 10,410,479 | B2 | 9/2019 | Beskitt et al. | |
| 11,151,846 | B1 * | 10/2021 | Pratten | G07F 19/206 |
| 2017/0185980 | A1 | 6/2017 | Wurmfeld | |
| 2019/0279454 | A1 | 9/2019 | Schwartz | |

OTHER PUBLICATIONS

Akinnuwes et al.: "Enhancing automated teller machine with multilingual and multi-denominational software functionalities", retrieved from https://lasu.edu.ng/publications/science/boluwaji_akinnuwesi_ia_08, Published in: Int. J. Electronic Finance, vol. 7, No. 2, 2013.

* cited by examiner

*Primary Examiner* — Daniel A Hess
(74) *Attorney, Agent, or Firm* — Rowand LLP

(57) ABSTRACT

A computer-implemented method is disclosed. The method includes: determining a current configuration of at least one cassette loaded into an automated teller machine; and automatically configuring one or more user interface settings of the automated teller machine based on the current configuration of the at least one cassette.

20 Claims, 6 Drawing Sheets

SYSTEM AND METHOD FOR CONFIGURING AN AUTOMATED TELLER MACHINE USER INTERFACE BASED ON LOADED CASSETTES

CROSS-REFERENCE TO RELATED APPLICATION

The present application is a continuation of U.S. patent application Ser. No. 16/893,965 entitled "Systems and Methods for Configuring an Automated Teller Machine User Interface Based on Loaded Cassettes", filed on Jun. 5, 2020, the contents of which are herein incorporated by reference.

TECHNICAL FIELD

The present application relates to automated teller machines and, more particularly, to systems and methods for configuring user interfaces of automated teller machines.

BACKGROUND

Automated teller machines allow certain banking activities to be performed without resort to a human bank teller. For example, withdrawals can be made and fulfilled by an automated teller machine by dispensing value instruments, such as banknotes. As another example, deposits can be made into a banking account with value instruments (e.g. banknotes, cheques, etc.) that are inserted directly into a deposit-enabled automated teller machine.

Payment networks allow customers of one financial institution to use automated teller machines of other financial institutions in performing transactions (e.g. withdrawals). In some cases, an automated teller machine that is used to perform a particular transaction may (for reasons such as, for example, geographic location, associated financial institution, etc.) denominate the transaction in a particular currency (e.g. a local currency). Meanwhile, the account relative to which such transactions are performed could be denominated in a different currency. This scenario may occur, for example, when a customer of one financial institution travels to another country and uses another financial institution's automated teller machine to make a withdrawal, deposit, etc. in a local currency.

BRIEF DESCRIPTION OF THE DRAWINGS

Embodiments are described in detail below, with reference to the following drawings.

Like reference numerals are used in the drawings to denote like elements and features.

DETAILED DESCRIPTION

Figure 1:
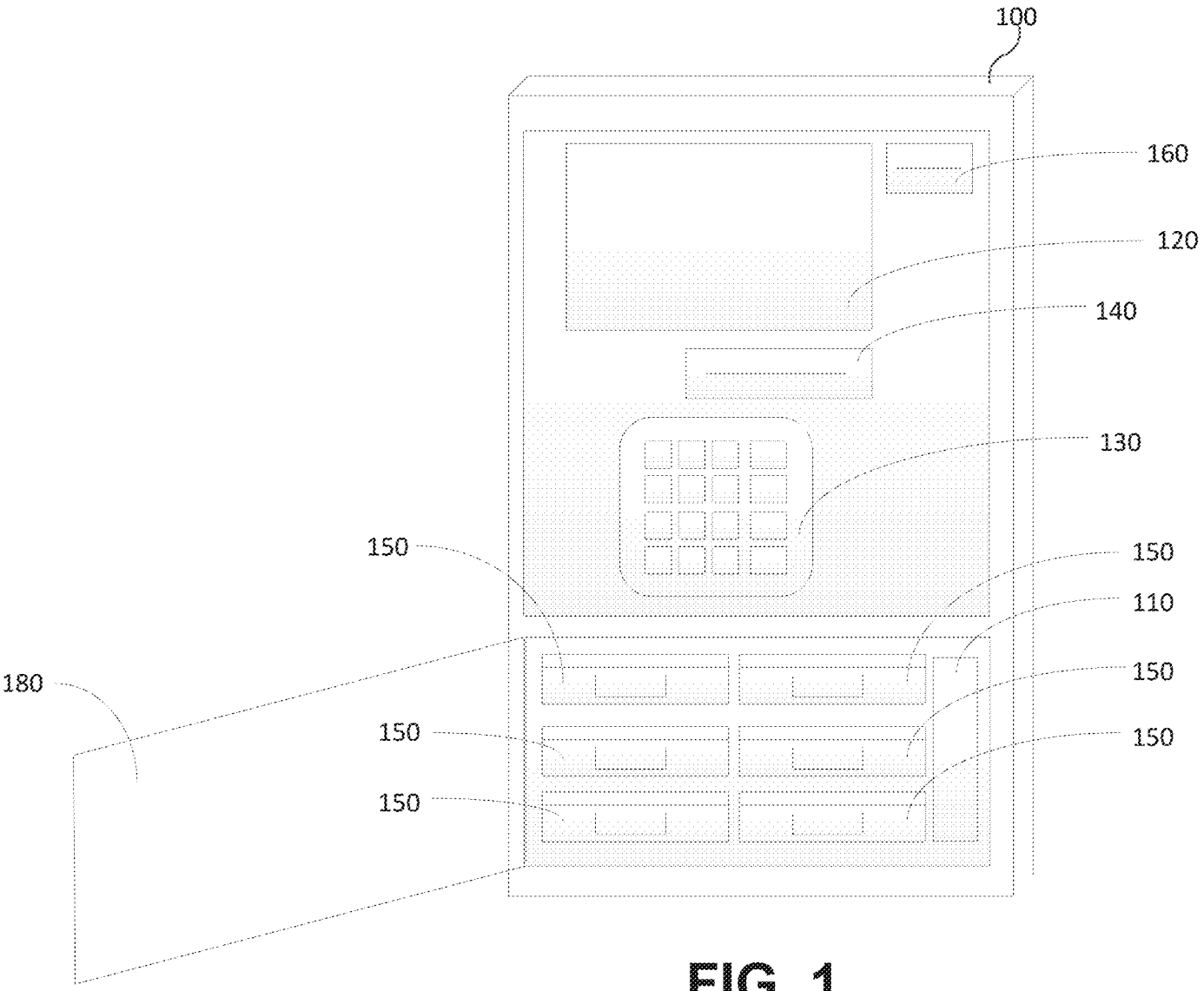
FIG. 1 is a simplified diagram showing components of an example automated teller machine.

In an aspect, an automated teller machine is disclosed. The automated teller machine includes a processor and a memory coupled to the processor. The memory stores instructions that, when executed by the processor, cause the automated teller machine to: determine a current configuration of at least one cassette loaded into the automated teller machine; and automatically configure one or more user interface settings of the automated teller machine based on the current configuration of the at least one cassette.

In some implementations, the automated teller machine may also include a display device, and the instructions, when executed by the processor, may further cause the automated teller machine to display, on the display device, a graphical user interface for the automated teller machine based on the one or more user interface settings.

In some implementations, the instructions, when executed by the processor, may further cause the automated teller machine to detect a trigger event and the current configuration of the at least one cassette may be determined in response to detecting the trigger event.

In some implementations, the trigger event may be one of: loading of the at least one cassette into the automated teller machine; boot-up of the automated teller machine; a power-on sequence of the automated teller machine; or closing of a cabinet of the automated teller machine.

In some implementations, determining the current configuration of the at least one cassette may include determining a type associated with a value instrument that is loaded in the at least one cassette.

In some implementations, the value instrument may be bank notes and determining a type associated with the value instrument may include determining at least one of currency or denomination of the bank notes.

In some implementations, the instructions, when executed by the processor, may further cause the automated teller machine to determine a current geographic location of the automated teller machine, and the one or more user interface settings may be configured based on the current configuration of the at least one cassette and the current geographic location of the automated teller machine.

In some implementations, the instructions, when executed by the processor, may further cause the automated teller machine to: compare the current geographic location of the automated teller machine and an issuing country for a currency of bank notes loaded in the at least one cassette; and determine whether dynamic foreign exchange should be offered for a transaction performed using the automated teller machine based on the comparing.

In some implementations, the instructions, when executed by the processor, may further cause the automated teller machine to: determine a currency of bank notes loaded in the at least one cassette; process transactions that are denominated in the currency; and display transaction information denominated in a currency associated with the current geographic location of the automated teller machine.

In some implementations, the at least one cassette may include two or more cassettes containing bank notes of at least two different currencies, and the instructions, when executed by the processor, may cause the automated teller machine to process transactions in the at least two different currencies.

In another aspect, a computer-implemented method is disclosed. The method includes: determining a current configuration of at least one cassette loaded into an automated teller machine; and automatically configuring one or more user interface settings of the automated teller machine based on the current configuration of the at least one cassette.

In yet another aspect, a non-transitory, computer-readable storage medium is disclosed. The storage medium contains instructions thereon that, when executed by a processor, configure the processor to: determine a current configuration of at least one cassette loaded into the automated teller machine; and automatically configure one or more user interface settings of the automated teller machine based on the current configuration of the at least one cassette.

Other aspects and features of the present application will be understood by those of ordinary skill in the art from a review of the following description of examples in conjunction with the accompanying figures.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

An automated teller machine may be configured to denominate transactions, such as withdrawals, deposits, etc., in one or more currencies. For convenience of users, it may be desirable to deploy multi-currency automated teller machines at strategic locations. For example, it would be desirable for an automated teller machine that is located at an airport, a hotel, etc. to allow customers to transact in multiple different currencies. As another example, a multi-currency automated teller machine may conceivably be used as a foreign exchange terminal, which may be useful for travellers vising a new country (and more generally, a new geographical region).

Typically, the functionalities of an automated teller machine (e.g. dispensing of banknotes, display of account information, etc.) are controlled by deploying unique or modified software images to the automated teller machine. Based on the particular user experience that is desired for an automated teller machine, a number of different software images that enable different functionalities may be installed on the automated teller machine. In particular, each software image may correspond to a different set of functionalities (i.e. user experience). Additionally, or alternatively, an operating software for an automated teller machine may read one or more static configuration files at start-up to determine which functionalities/user experience settings to provide to users of the automated teller machine.

The use of multiple software images for controlling user experience on automated teller machines poses a challenge to managing fleets of multiple automated teller machines. Each software image may require extensive and costly testing, and the overhead burden associated with use of multiple software images may hamper the ability to release new features for automated teller machines.

The present application discloses techniques for controlling user experience on automated teller machines. In accordance with disclosed embodiments, an automated teller machine may automatically configure user experience presented to end users based on the cassettes that are loaded into the automated teller machine. Upon detecting one or more predefined trigger events, an automated teller machine may be configured to determine current configuration data for at least one of the cassettes that are loaded into the automated teller machine. The automated teller machine automatically configures user interface settings based on the current configuration data of the loaded cassettes. A user interface that is based on the configured user interface settings can then be presented, for example, to users of the automated teller machine.

FIG. 1 illustrates example components of an automated teller machine 100. The automated teller machine 100 is adapted to provide access to banking services such as, for example, withdrawals and deposits. As shown in FIG. 1, the automated teller machine 100 may include a controller 110, a display 120, a keypad 130, an item receiver/dispenser 140, cassettes 150, and/or a card reader 160.

As further described below, the controller 110 is a computing device. For example, the controller 110 may include a processor that executes instructions retrieved from a computer-readable medium thereby causing the automated teller machine 100 to perform operations for providing access to banking services.

The display 120 may for example, be a liquid-crystal display (LCD), a cathode-ray tube (CRT), or the like. The display 120 is for presenting a user interface to a user of the automated teller machine 100. The display 120 may present information, such as, for example, a user interface for the automated teller machine 100, under control of the controller 110.

The keypad 130 is an input device allowing input to be provided to the automated teller machine 100. Input received via the keypad 130 may be conveyed to the controller 110. Notably, the keypad 130 may be used by a user to provide a personal identification number (PIN) to the automated teller machine 100 as a part of authenticating to the automated teller machine 100.

The item receiver/dispenser 140 is a mechanical device allowing value instruments to be obtained by and dispensed by the automated teller machine 100. For example, it may be that the item receiver/dispenser 140 provides a single slot through which value instruments are received and dispensed. Additionally, or alternatively, the item receiver/dispenser 140 may provide multiple slots such as, for example, one or more slots for receiving value instruments and one or more slots for dispensing value instruments. In some embodiments, the item receiver/dispenser 140 may consist of multiple mechanical units. Each such mechanical unit may be in communication with a respective slot of the automated teller machine 100. Additionally, or alternatively, one or more of the mechanical units may communicate with the same slot, i.e. a shared slot. It may be that components or units of the item receiver/dispenser 140 are specialized to a particular type or types of value instrument. For example, a particular component or unit of the item receiver/dispenser 140 may be adapted to receiving and/or dispensing banknotes of one denomination, while another component or unit may be adapted to receiving and/or dispensing banknotes of another denomination. Alternatively, it may be that the item receiver/dispenser 140 is a monolithic unit that handles all manner of value instruments.

The item receiver/dispenser 140 is in communication with the cassettes 150. Each of the cassettes 150 is adapted to receive and/or dispense value instruments. For example, a cash cassette (also known as a dispensing cassette) of the cassettes 150 may be loaded with value instruments (e.g. bank notes of one or various currencies, event or transit tickets, etc.) that can be dispensed to satisfy withdrawals. In another example, a deposit cassette of the cassettes 150 may be adapted to receive value instruments that are provided for deposit. Cassettes may also be referred to as canisters.

The card reader 160 allows data to be read from a card such as, for example, a common ISO-sized ATM or cheque card. For example, the card reader 160 may allow data to be read from magnetic stripe cards and/or chip cards. In some embodiments, the card reader 160 may require a card to be swiped through it to be read (a so-called "swipe reader") and/or it may allow a card to be inserted into it for reading (a so-called "dip reader"). In some embodiments, the card reader 160 may be adapted to allow inserted cards to be retained by the automated teller machine 100 indefinitely (such as if fraud is suspected) and/or for the period of a session.

One or both of the controller 110 and the cassettes 150 may, as illustrated, be disposed within a cabinet 180 of the automated teller machine 100.

Figure 2:
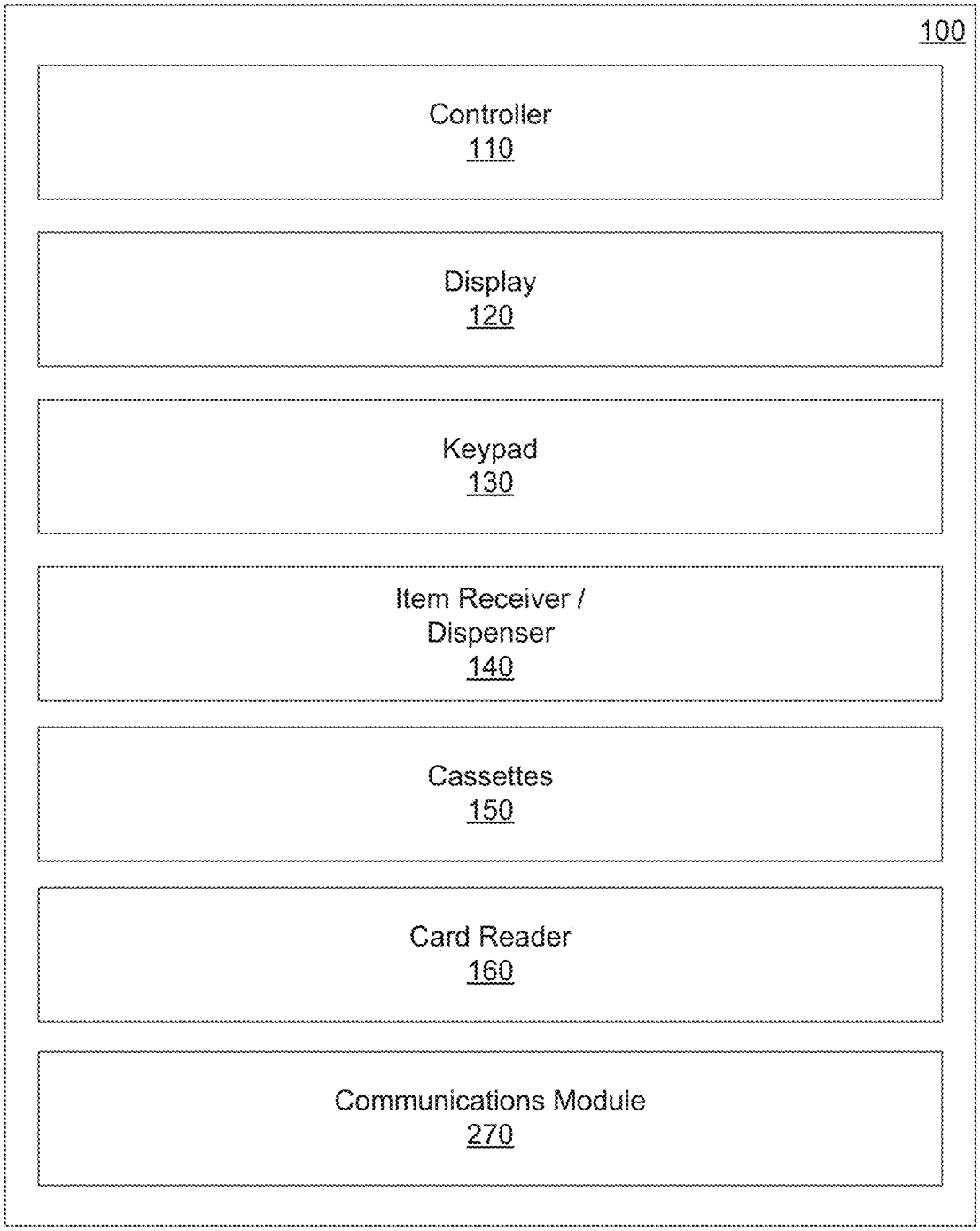
FIG. 2 is a logical block diagram of the example automated teller machine of FIG. 1.

FIG. 2 is a logical block diagram of the automated teller machine 100. As described above, the automated teller machine 100 may include a controller 110, a display 120, a keypad 130, an item receiver/dispenser 140, cassettes 150, and a card reader 160 as described above. Additionally, as shown in FIG. 2, the automated teller machine 100 may include a communications module 270.

The communications module 270 allows the automated teller machine 100 to communicate with other computing devices and/or various communications networks. In other words, the communications module 270 may allow the automated teller machine 100 to send or receive communications signals. Communications signals may be sent or received according to one or more protocols or according to one or more standards. For example, the communications module 270 may allow the automated teller machine 100 to communicate via an Ethernet network, an ATM network, a telephone network, and/or via cellular data network, such as for example, according to one or more standards such as, for example, Global System for Mobile Communications (GSM), Code Division Multiple Access (CDMA), Evolution Data Optimized (EVDO), Long-term Evolution (LTE) or the like. Additionally, or alternatively, the communications module 270 may allow the automated teller machine 100 to communicate using near-field communication (NFC), via Wi-Fi™, using Bluetooth™ or via some combination of one or more networks or protocols.

Figure 3:
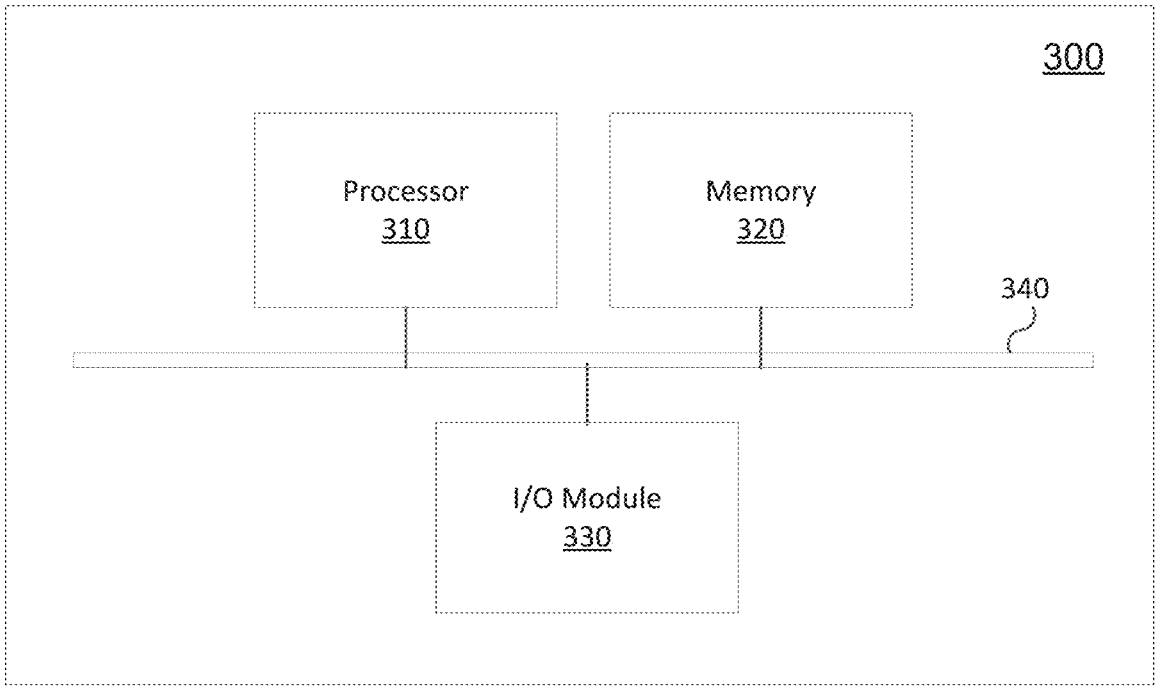
FIG. 3 is a high-level operation diagram of an example computing device.

FIG. 3 is a high-level operation diagram of an example computing device 300. In some embodiments, the example computing device 300 may be exemplary of the controller 110 (FIG. 1). The automated teller machine 100 (FIG. 1) includes software that adapts it to perform a particular function. That software may provide one or more user interfaces (e.g. using the display 120) for accessing the functionality of the automated teller machine. According to the subject matter of the present application, the automated teller machine may, as further described below, automatically configure such a user interface based on some or all of the cassettes 150 (e.g. based on the dispensing/cash ones of the cassettes 150) that are loaded into the automated teller machine 100.

The example computing device 300 includes a variety of modules. For example, as illustrated, the example computing device 300 may include a processor 310, a memory 320, and an input/output (I/O) module 330. As illustrated, the foregoing example modules of the example computing device 300 are in communication over a bus 340.

The processor 310 is a hardware processor. The processor 310 may, for example, be one or more ARM, Intel x86, PowerPC processors or the like.

The memory 320 allows data to be stored and retrieved. The memory 320 may include, for example, random access memory, read-only memory, and persistent storage. Persistent storage may be, for example, flash memory, a solid-state drive or the like. Read-only memory and persistent storage are each a non-transitory computer-readable storage medium. A computer-readable medium may be organized using a file system such as may be administered by an operating system governing overall operation of the example computing device 300.

The I/O module 330 allows the example computing device 300 to interact with devices such as, for example, peripherals to send and receive data. The I/O module 330 may, for example, allow the example computing device 300 to interface with input devices such as, for example, keypads, keyboards, pointing devices, and the like. In another example, the I/O module 330 may, for example, allow the example computing device 300 to interface with output devices such as, for example, displays, printers, and the like. In a particular example, where the example computing device 300 forms a part of the automated teller machine 100 (FIG. 1) such as, for example, if the example computing device 300 is or forms a part of the controller 110 (FIG. 1) of the automated teller machine 100, the I/O module 330 may allow the example computing device 300 to interface with, for example, one or more of the display 120, the keypad 130, the item receiver/dispenser 140, the card reader 160, and/or the communications module 270.

Software comprising instructions is executed by the processor 310 from a computer-readable medium. For example, software may be loaded into random-access memory from persistent storage of the memory 320. Additionally, or alternatively, instructions may be executed by the processor 310 directly from read-only memory of the memory 320.

Figure 4:
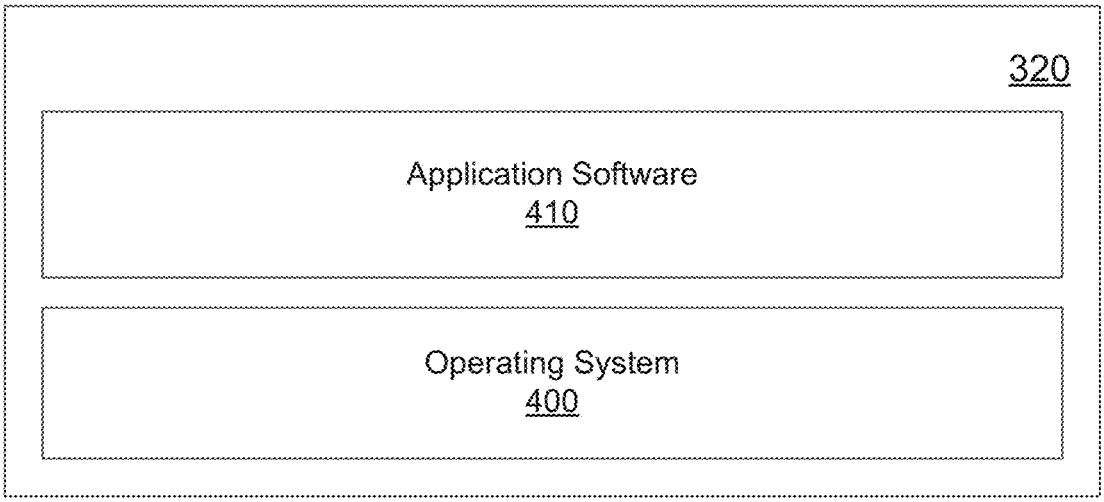
FIG. 4 depicts an example simplified software organization of the example computing device of FIG. 3.

FIG. 4 depicts a simplified organization of software components stored in the memory 320 of the example computing device 300. As illustrated, these software components include an operating system 400 and application software 410.

The operating system 400 is software. The operating system 400 allows the application software 410 to access the processor 310, the memory 320, and the I/O module 330. The operating system 400 may be, for example, UNIX™, Linux™, Microsoft™ Windows™, Apple OSX™ or the like.

The application software 410 adapts the example computing device 300, in combination with the operating system 400, to operate as a device performing a particular function. For example, the application software 410 may cooperate with the operating system 400 to adapt a suitable embodiment of the example computing device 300 to operate as the controller 110 (FIG. 2) of the automated teller machine 100 (FIG. 1).

Various methods for configuring user interface of the automated teller machine 100 for use in dispensing value instruments of different types will now be discussed.

According to the present application, the automated teller machine 100 configures user interface thereof such as, for example, one or more user interfaces used for configuring withdrawals. The automated teller machine 100 configures the user interface based on some or all of the cassettes 150 that are loaded into the automated teller machine 100. For example, the user interface may be configured based on some or all of the dispensing (e.g. cash) ones of the cassettes 150. Such cash cassettes may be loaded into the automated teller machine 100 to load/unload it by a variety of persons such as, for example, armoured car carriers (ACC) and/or other persons charged with loading/reloading the automated teller machine 100 with value instruments, etc.

Operations performed by the automated teller machine 100 will be described below with reference to FIGS. 5-7.

Figure 5:
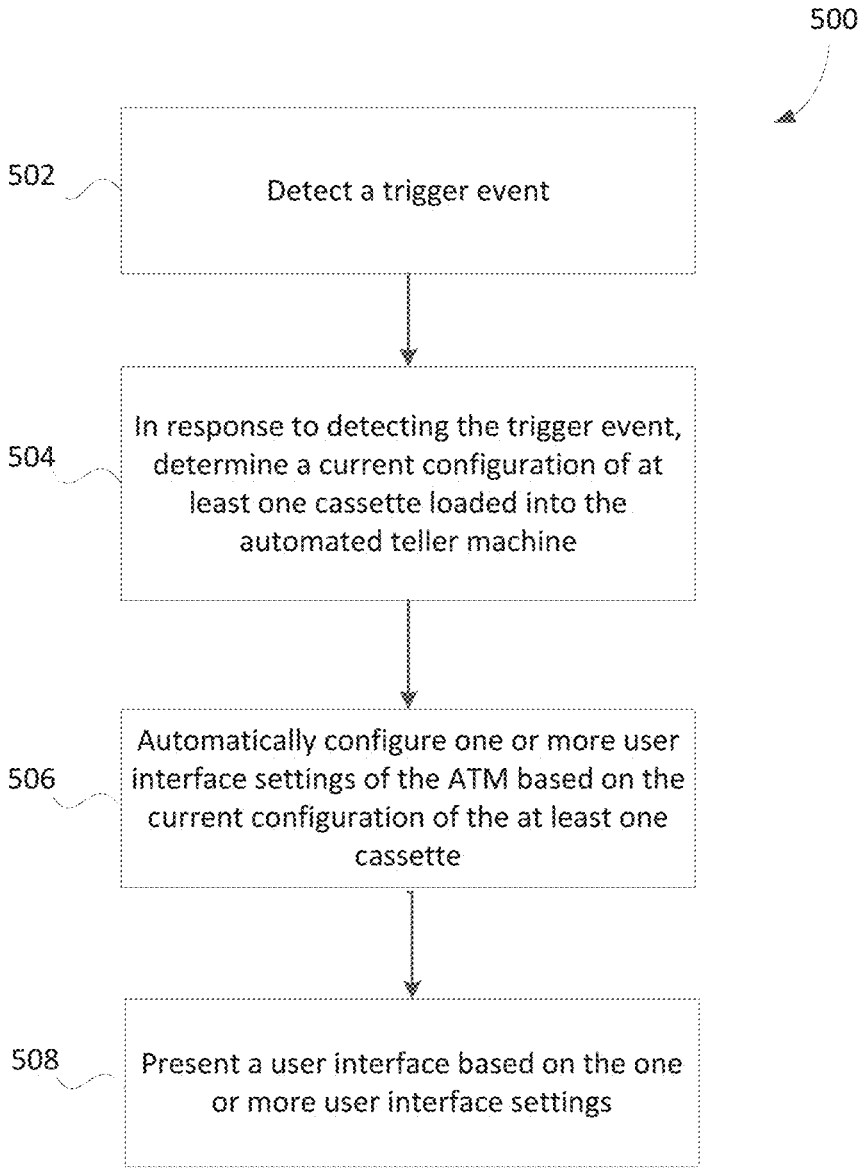
FIG. 5 shows, in flowchart form, an example method for configuring a user interface of an automated teller machine.

FIG. 5 illustrates, in flowchart form, an example method 500 for configuring a user interface of an automated teller machine. In particular, the operations of example method 500 may be performed in configuring a user interface that is suitable for use in dispensing value instruments of different types from an automated teller machine. Operations 502 and onward are performed by one or more processors of a controller, such as the controller 110 (FIG. 1) of the automated teller machine 100. For example, where the controller is or includes an instance of the example computing device 300 (FIG. 3), it may be that the method 500 is performed by the processor 310 (FIG. 3) executing software such as, for example, a suitable instance of the application software 310 (FIG. 4).

In operation 502, a trigger event is detected. As will be further described below, the detection of the trigger event initiates configuration (or re-configuration, if previously configured) of the automated teller machine. In particular, a user interface of the automated teller machine is configured based on some or all of the cassettes loaded in the automated teller machine, as mentioned above.

The detected event may take a variety of forms. For example, the event may correspond to a boot-up, a start-up, or a power-on sequence of the automated teller machine and/or the controller. In another example, the event may correspond to the loading of one or more of cassettes into the automated teller machine. In yet another example, the event may correspond to an opening and/or a closing of the cabinet associated with the automated teller machine. In a yet further example, the event may correspond to any of a set of events and/or a series or sequence of events occurring such as, for example, in a defined order or in tandem. For example, the event may correspond to one or more of the foregoing example events having occurred either individually and/or in a defined order and/or in one of several defined orders.

Regardless of the form of the event and its detection, responsive to detecting the trigger event at operation 502, an operation 504 is next. In operation 504, the automated teller machine determines a current configuration of the loaded cassettes. Some or all of the cassettes in the automated teller machine are detected. This detection may take a variety of forms. For example, some or all of the cassettes may be inspected and/or scanned to determine their type and/or configuration. In some cases, only newly-loaded ones of the cassettes (i.e. those cassettes recently loaded into the automated teller machine) may be scanned.

Dispensing cassettes will typically hold a homogenous set of value instruments. For example, a given cassette may hold banknotes of a particular currency and denomination. One or more factors such as be characteristic of the contents of a given cassette may be considered a part of its configuration data as detected. For example, a given cassette's configuration data may include information about some or all of: a) the type of the value instruments the cassette holds (e.g. bank notes, tickets, etc.); b) denomination/amount of value instruments the cassette holds (e.g. denomination of banknotes), and/or type of value instruments the cassette holds (e.g. currencies, in the case of banknotes). The current configuration data for loaded cassettes may be stored in memory of the automated teller machine. In particular, the current configuration data for cassettes may be dynamically updated based on detected events or changes associated with the automated teller machine.

The automated teller machine may determine the current configuration of a given cassette in various ways. For example, it may be that one or more mechanisms are used by a given cassette to signal its configuration to the automated teller machine and/or by the automated teller machine to read the configuration of a given cassette. Such signalling of the configuration of a cassette and/or the configuration of a cassette to so signal may be referred to as "pinning". Mechanisms may take a variety of forms and various mechanisms may be employed without departing from the subject matter of the present application. To provide examples of possible mechanisms, it is noted that, for example, a given cassette's configuration may be indicated by one or more of a) defined signaling pins on a connector, with various pins used in signalling aspects of a cassette's configuration (e.g. configuration factors as discussed above); b) a radio-frequency identification (RFID) tag adapted to signal the configuration; c) a signal sent over a serial or parallel data bus connecting the cassette to an automated teller machine into which it is loaded (e.g. by way of a suitable connector pair); d) dip switches, e) a combination of one or more of the foregoing; and/or the like. Notably, the type of banknotes in a cassette may be signalled by signalling an indication of an ISO country code corresponding to the issuing jurisdiction of a given currency.

Following the determination of current configuration data for the cassettes at operation 504, an operation 506 is next. In operation 506, user interface settings of the automated teller machine are automatically configured based on the current configuration of cassettes detected at operation 504. Put another way, one or more user interface settings of the automated teller machine are automatically configured based on the current configuration of at least one of the cassettes determined in operation 506, following the detection of cassettes at the operation 504.

The configuration of the user interface setting(s) may take a variety of forms including, for example, the modification of one or more configuration variables (e.g. as may be stored in a memory of the controller), the modification of and/or selection between one or more configuration files, or the like. Whatever the underlying mechanism used to achieve it, such a modification of the configuration of the user interface settings may have a variety of effects on the user interface presented by the automated teller machine (e.g. by way of a display) as further described below.

Following the operation 506, at operation 508, a user interface is presented by the automated teller machine, with the particular user interface presented and/or details thereof being based on the user interface settings configured at operation 508. Put another way, at operation 508, a user interface is presented by the automated teller machine based on the one or more user interface settings configured at the operation 506. For example, a graphical user interface that is configured based on the current configurations of loaded cassettes may be displayed on a display device associated with the automated teller machine.

Examples of how user interface(s) of the automated teller machine may be provided based on user interface settings as can be configured based on loaded cassettes in accordance with the subject matter of the present application will now be discussed. By way of overview, in at least some of the examples, it may be considered that the user interface is customized and/or localized based on user interface settings.

In a first example, if it is determined that the automated teller machine has been loaded such that all loaded cash cassettes hold only Canadian bills, the controller and software executed thereby may configure the user interface of the automated teller machine to present the customer with an experience specific to the Canadian locale. Put another way, the automated teller machine may be configured to provide functionality and user interface specific to the Canadian market so that, for example, the machine only accepts and dispenses only Canadian currency and the Canadian dollar is used to denominate transactions. Similarly, the automated teller machine may adapt to being loaded only with bills of other currencies: for example, if loaded with United States banknotes, the user interface may be configured to provide an experience for the United States where U.S. currency is accepted and dispensed and used to denominate transactions.

In a variation of the foregoing, if the automated teller machine is capable of determining and/or is configured with its location, it may compare its location to determine whether it is in the country that issues the loaded currency and may provide a domestic automated teller machine experience if the currency matches the locale (including denominating transactions in the loaded currency) or may instead provide a foreign-exchange automated teller machine experience if the currency does not match—e.g. with the foreign currency being dispensed (and potentially also accepted), but the transactions being denominated in the local currency/currency of the country where the automated teller machine is located (e.g. with amounts of banknotes of other currencies withdrawn or denominated being converted at current foreign exchange to process transactions such as, for example, by debiting or crediting a user's account).

In a second example, it may be that the automated teller machine is loaded with bills of multiple currencies. For example, if the automated teller machine has some cassettes that are loaded with Canadian bills and other cassettes loaded with U.S. bills, then the controller and software executed thereby would recognize that and present the customer with a user experience that allows them to transact in both currencies. That is, the automated teller machine may be configured to process transactions in two or more different currencies. Notably, the automated teller machine may be configured to select one of those currencies (or even to select another currency) to denominate a transaction. For example, it may be that transactions are denominated in the local currency based on the location of the automated teller machine akin to as discussed above. In a particular example, if the automated teller machine has some cassettes that are loaded with Euros (EUR) and other cassettes that are loaded with United States banknotes then, if the automated teller machine is located in Canada, the controller and software executed thereby may be configured to present the customer with a user experience that allows them to transact in both Euros and U.S. dollars (USD) but with the underlying transactions denominated/processed in Canadian dollars.

In a third example, it may be that at least some of the loaded cassettes hold value instruments other than banknotes such as, for example, transit or movie tickets (or other tickets of predetermined type(s)). If the automated teller machine is loaded with one or more cassettes holding Canadian banknotes (CAD) and also with a cassette loaded with tickets (e.g. transit tickets), then the controller and software executed thereby would recognize that and configure the automated teller machine to present a user of the automated teller machine with a user experience allowing transacting in Canadian currency and also allowing the purchase of tickets.

Beyond customization based on loaded value instruments, other factors related to loaded cassettes may be considered in configuring the automated teller machine and, more specifically, user interface(s) thereof such as, for example, the overall cash level of the automated teller machine (e.g. total amount in its various cash cassettes) and/or the number of value instruments stored in a given cassette/cassettes. In another example, in some implementations, the automated teller machine may, additionally or alternatively, customize particular elements of its user interface based on the various denominations of value instruments (e.g. the mix of banknotes) loaded into the machine. In a particular example, the automated teller machine may, where it is loaded with a multiple denominations of a given currency, allow a customer not only to specify the amount of a withdrawal to be satisfied in that currency, but also the particular mix of bills that will be dispensed (e.g. to select to receive $100 as eight 10-dollar and one 20-dollar bill, as opposed to as five 20-dollar bills). Conveniently, by customizing the providing of this functionality based on loaded cassettes, such functionality can be provided without requiring a standardized set of cassettes. For example, the bill mix offered by the automated teller machine may be customized based on the location where the automated teller machine is deployed and a withdrawal user may be customized based on that bill mix. In this way, a college campus automated teller machine could be loaded with cassettes holding low denomination bills (e.g. $5s and $10s), while a casino automated teller machine could be loaded primarily or entirely with cassettes holding high denomination bills (e.g. $50s and $100s), and, by employing the subject matter of the present application, the user interface of each automated teller machine could be appropriately customized to allow a user to choose how to satisfy their withdrawal using the loaded bills.

In at least some implementations, customizing the user interface of the automated teller machine based on the loaded cassettes may allow the automated teller machine to be deployed and/or redeployed to various locations/in various use cases without requiring manual reconfiguration of the automated teller machine. Notably too, having the automated teller machine adapt its configuration based the different types of cassettes as may be loaded therein and provide functionality and user interface and functionality based on the loaded cassettes may allow use of a single software image (e.g. as a part of software of the controller), rather than requiring different images for different configurations/scenarios (e.g. where a software image is loaded into the controller that was selected from amongst a set of different images corresponding to different types of deployments). Using a single software image may reduce automated teller machine maintenance costs and/or costs/overhead for developing software to control the automated teller machine.

The subject matter of the present application may be employed in a variety of scenarios. For example, it could be employed in providing an automated teller machine at a location which travellers may visit (e.g. airport and/or hotel locations), with that automated teller machine allowing customers to transact in multiple currencies. In another example, it could be employed in automated teller machines located at transit locations (e.g. rapid transit stations) to configure the machine to allow customers to both perform cash transactions and to also purchase transit tickets. In yet another example, it could be employed in configuring an automated teller machine to allow it to act as a foreign exchange terminal.

Figure 6:
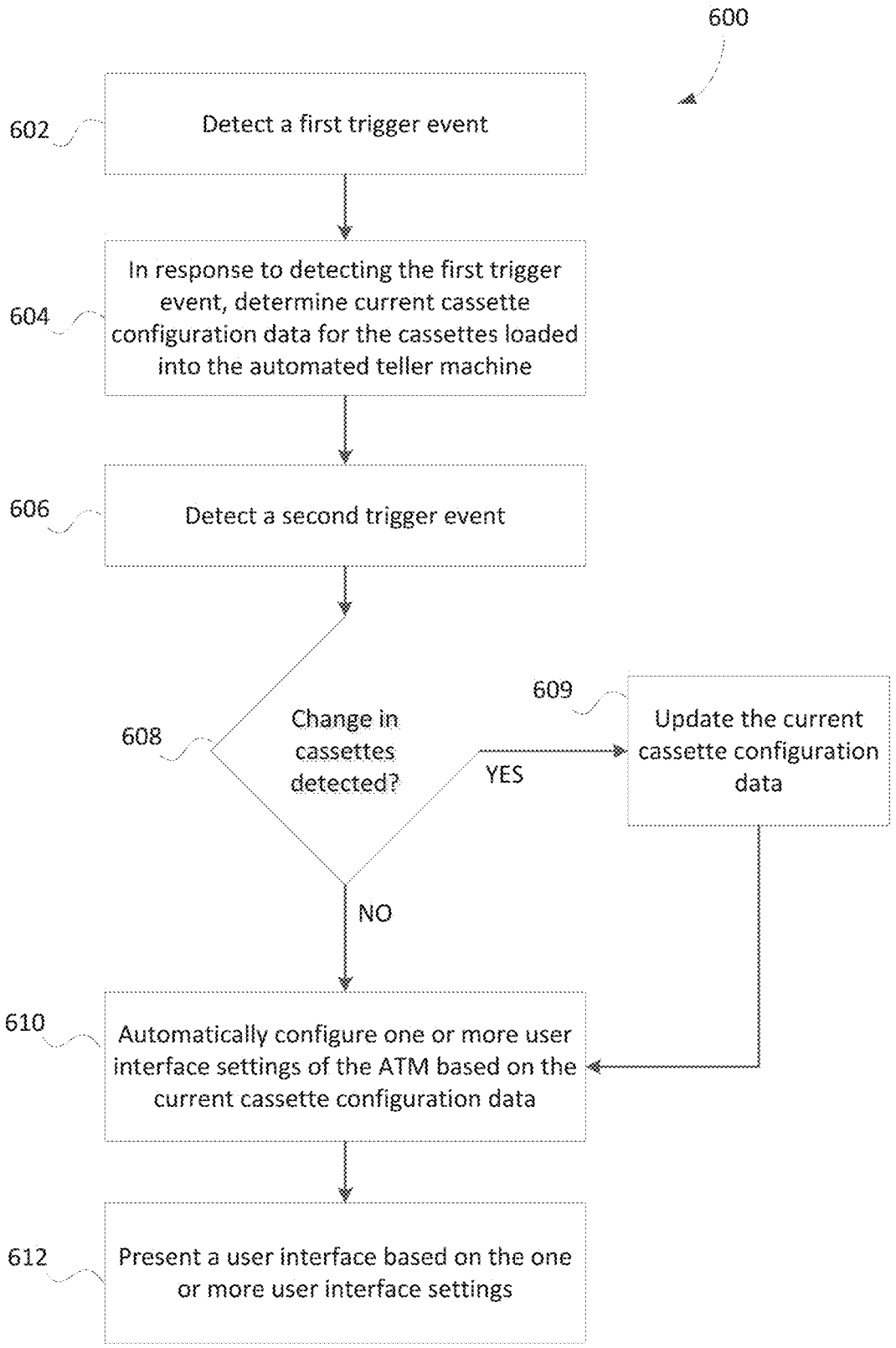
FIG. 6 shows, in flowchart form, another example method for configuring a user interface of an automated teller machine.

Reference is now made to FIG. 6 which shows, in flowchart form, another example method 600 for configuring a user interface associated with an automated teller machine. The operations of method 600 may be performed in configuring a user interface that is suitable for use in dispensing value instruments from an automated teller machine. Operations 602 and onward are performed by one or more processors of a controller, such as the controller 110 (FIG. 1) of the automated teller machine 100. It will be noted that the operations of method 600 may be performed in addition to, or as alternatives, to one or more of the operations of method 500.

Operations 602 and 604 correspond to, and may be performed in a similar manner, as operations 502 and 504 of method 500. The automated teller machine detects a trigger event, such as the loading of a cassette, a power-on sequence, etc., in operation 602, and responsive to the detection, the automated teller machine determines current cassette configuration data for some or all of the cassettes that are loaded into the automated teller machine (operation 604).

In operation 606, the automated teller machine detects a second trigger event. The second trigger event may, for example, be the loading of a new cassette into the automated teller machine, a device boot-up, opening and/or closing of a cabinet of the automated teller machine, etc. The second trigger event may be the same type of event as the first trigger event, or a different type. The automated teller machine then determines if there has been a change to the set of loaded cassettes, in operation 608. In particular, the automated teller machine detects whether the configuration of at least one of the loaded cassettes has changed as a result of the second trigger event. The automated teller machine may, for example, detect that a new cassette replacing a previous cassette has been loaded, or that an additional cassette is added to the current set of loaded cassettes. For example, the automated teller machine may determine that there has been a change to the set of cassettes if a cassette containing a new or different type of value instrument (e.g. different currencies or denominations, different tickets, etc.) is detected as being loaded into the automated teller machine.

If a change from the previous configuration of cassettes is detected, the automated teller machine may update the current cassette configuration data, in operation 609. In particular, the automated teller machine may indicate the nature of the specific change (e.g. a cassette contains new type of value instrument, an addition to the current set of loaded cassettes, etc.) to the cassettes and the changed configuration data for the loaded cassette(s).

Following the update of cassette configuration data, the automated teller machine automatically configures user interface settings based on the current cassette configuration data, in operation 610. For example, display information, or information which may be displayed on a display device, of the automated teller machine may be configured in accordance with the updated cassette configuration data. The changes to the display information may include: changes to data fields and associated data entries; addition, deletion, or modification of user-selectable interface elements/options; and changes to notifications and messages.

A user interface that is configured based on the updated user interface settings can then be presented by the automated teller machine, in operation 612. In at least some embodiments, the operation 610 and 612 correspond to, and may be performed similarly as, the operations 506 and 508 of method 500.

Figure 7:
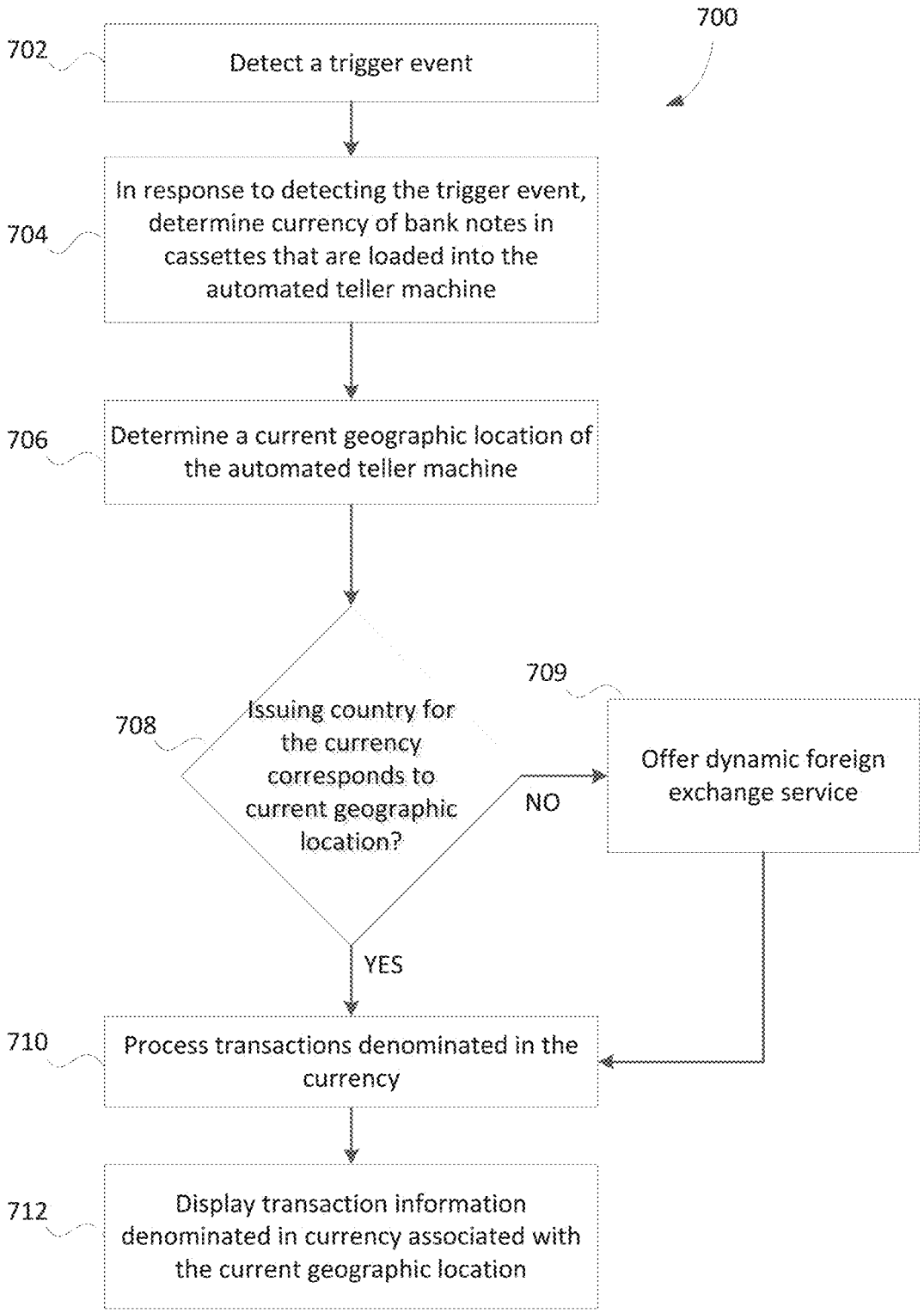
FIG. 7 shows, in flowchart form, another example method for configuring a user interface of an automated teller machine.

Reference is now made to FIG. 7 which shows, in flowchart form, another example method 700 for configuring a user interface associated with an automated teller machine. the operations of example method 700 may be performed in configuring a user interface that is suitable for use in dispensing value instruments from an automated teller machine. Operations 702 and onward are performed by one or more processors of a controller, such as the controller 110 (FIG. 1) of the automated teller machine 100. It will be noted that the operations of method 700 may be performed in addition to, or as alternatives, to one or more of the operations of methods 500 and 600.

In operation 702, the automated teller machine detects a trigger event (e.g. loading of one or more cassettes into the automated teller machine, boot-up condition, power-on sequence, etc.). In response to detecting the trigger event, the automated teller machine determines the currencies of banknotes in the cassettes that are currently loaded into the automated teller machine, in operation 704. The identification of the currencies (and other configurations) associated with the loaded cassettes may be performed by the automated teller machine in accordance with the embodiments described above.

In operation 706, the automated teller machine determines a current geographic location of the automated teller machine. That is, the automated teller machine detects a current location, including geographic identifiers (and more generally, information that indicates the geographic or spatial location), of the automated teller machine. For example, the automated teller machine may determine a country, a state, a locality (e.g. city or town), as well as location descriptors (e.g. identity of facility, indoor location, etc.) for its current location. The current geographic location information may be hard-coded in memory of the automated teller machine, or obtained from a remote source, such as an automated teller machine management server.

In operation 708, the automated teller machine determines whether the currencies of the banknotes in the loaded cassettes correspond to the current geographic location of the automated teller machine. In particular, the automated teller machine identifies the issuing countries (or geographical regions) associated with the currencies of the banknotes, and determines whether there is a match between the issuing country/geographical region information and the location data associated with the automated teller machine. For example, a cassette loaded into the automated teller machine may hold U.S. dollars (or banknotes of another foreign currency), and the automated teller machine may be determined to be located in Canada.

If the issuing country/geographical region does not correspond to the current geographic location of the automated teller machine, the automated teller machine may offer dynamic foreign exchange service, in operation 709. Specifically, the automated teller machine may be configured to provide foreign exchange services for transactions (e.g. withdrawals) that are performed using the automated teller machine. In at least some embodiments, a switch associated with the automated teller machine may determine whether dynamic foreign exchange should be provided. An automated teller machine switch ("ATM switch") is adapted to broker communication between the automated teller machine, one or more payment networks, and other systems (e.g. back-end system of a financial institution associated with the automated teller machine). The ATM switch assists with performing various functions related to transactions using the automated teller machine.

In operation 710, the automated teller machine processes transactions that are denominated in the currencies associated with the loaded cassettes. That is, once the currencies of banknotes contained in cassettes that are loaded into the automated teller machine are determined, the automated teller machine may be configured to process transactions that are denominated in those currencies.

The automated teller machine may display the transaction information denominated in a currency that is associated with the current geographic location of the automated teller machine. That is, even where the transactions performed using the automated teller machine are denominated in the currencies associated with the loaded cassettes, the displayed information (and more generally, user interface settings) for the automated teller machine may be provided in a currency of the geographical region where the automated teller machine is currently located.

In accordance with the method 700, the user interface settings are configured based on the current configuration of the one or more loaded cassettes and the current geographic location of the automated teller machine.

Example embodiments of the present application are not limited to any particular operating system, system architecture, mobile device architecture, server architecture, or computer programming language.

It will be understood that the applications, modules, routines, processes, threads, or other software components implementing the described method/process may be realized using standard computer programming techniques and languages. The present application is not limited to particular processors, computer languages, computer programming conventions, data structures, or other such implementation details. Those skilled in the art will recognize that the described processes may be implemented as a part of computer-executable code stored in volatile or non-volatile memory, as part of an application-specific integrated chip (ASIC), etc.

As noted, certain adaptations and modifications of the described embodiments can be made. Therefore, the above discussed embodiments are considered to be illustrative and not restrictive.

The invention claimed is:

1. An automated teller machine comprising:

a processor;

a memory coupled to the processor and storing instructions that, when executed by the processor, cause the automated teller machine to:

determine a current configuration of at least one cassette loaded into the automated teller machine; and automatically configure one or more user interface settings of the automated teller machine based on the current configuration of the at least one cassette.

2. The automated teller machine of claim 1, further comprising a display device, wherein the instructions, when executed by the processor, further cause the automated teller machine to display, on the display device, a graphical user interface for the automated teller machine based on the one or more user interface settings.

3. The automated teller machine of claim 1, wherein the instructions, when executed by the processor, further cause the automated teller machine to detect a trigger event and wherein the current configuration of the at least one cassette is determined in response to detecting the trigger event.

4. The automated teller machine of claim 3, wherein the trigger event comprises one of:

loading of the at least one cassette into the automated teller machine;

boot-up of the automated teller machine;

a power-on sequence of the automated teller machine; or closing of a cabinet of the automated teller machine.

5. The automated teller machine of claim 1, wherein determining the current configuration of the at least one cassette comprises determining a type associated with a value instrument that is loaded in the at least one cassette.

6. The automated teller machine of claim 5, wherein the value instrument comprises bank notes and wherein determining a type associated with the value instrument comprises determining at least one of currency or denomination of the bank notes.

7. The automated teller machine of claim 1, wherein the instructions, when executed by the processor, further cause the automated teller machine to determine a current geographic location of the automated teller machine, and wherein the one or more user interface settings are configured based on the current configuration of the at least one cassette and the current geographic location of the automated teller machine.

8. The automated teller machine of claim 7, wherein the instructions, when executed by the processor, further cause the automated teller machine to:

compare the current geographic location of the automated teller machine and an issuing country for a currency of bank notes loaded in the at least one cassette; and determine whether dynamic foreign exchange should be offered for a transaction performed using the automated teller machine based on the comparing.

9. The automated teller machine of claim 7, wherein the instructions, when executed by the processor, further cause the automated teller machine to:

determine a currency of bank notes loaded in the at least one cassette;

process transactions that are denominated in the currency; and display transaction information denominated in a currency associated with the current geographic location of the automated teller machine.

10. The automated teller machine of claim 1, wherein the at least one cassette comprises two or more cassettes containing bank notes of at least two different currencies, and wherein the instructions, when execute by the processor, cause the automated teller machine to process transactions in the at least two different currencies.

11. A computer-implemented method, comprising:

determining a current configuration of at least one cassette loaded into an automated teller machine; and automatically configuring one or more user interface settings of the automated teller machine based on the current configuration of the at least one cassette.

12. The method of claim 11, further comprising displaying, on a display device, a graphical user interface for the automated teller machine based on the one or more user interface settings.

13. The method of claim 11, further comprising detecting, by the automated teller machine, a trigger event and wherein the current configuration of the at least one cassette is determined in response to detecting the trigger event.

14. The method of claim 13, wherein the trigger event comprises one of:

loading of the at least one cassette into the automated teller machine;

boot-up of the automated teller machine;

a power-on sequence of the automated teller machine; or closing of a cabinet of the automated teller machine.

15. The method of claim 11, wherein determining the current configuration of the at least one cassette comprises determining a type associated with a value instrument that is loaded in the at least one cassette.

16. The method of claim 15, wherein the value instrument comprises bank notes and wherein determining a type associated with the value instrument comprises determining at least one of currency or denomination of the bank notes.

17. The method of claim 11, further comprising determining a current geographic location of the automated teller machine, and wherein the one or more user interface settings are configured based on the current configuration of the at least one cassette and the current geographic location of the automated teller machine.

18. The method of claim 17, further comprising:

comparing the current geographic location of the automated teller machine and an issuing country for a currency of bank notes loaded in the at least one cassette; and determining whether dynamic foreign exchange should be offered for a transaction performed using the automated teller machine based on the comparing.

19. The method of claim 17, further comprising:

determining a currency of bank notes loaded in the at least one cassette;

processing transactions that are denominated in the currency; and displaying transaction information denominated in a currency associated with the current geographic location of the automated teller machine.

20. The method of claim 11, wherein the at least one cassette comprises two or more cassettes containing bank notes of at least two different currencies, and wherein the method further comprises processing transactions in the at least two different currencies.

* * * * *